US006577736B1

(12) United States Patent
Clemow

(10) Patent No.: US 6,577,736 B1
(45) Date of Patent: Jun. 10, 2003

(54) METHOD OF SYNTHESIZING A THREE DIMENSIONAL SOUND-FIELD

(75) Inventor: Richard David Clemow, Bucks (GB)

(73) Assignee: Central Research Laboratories Limited, Hayes (GB)

( * ) Notice: Subject to any disclaimer, the term of this patent is extended or adjusted under 35 U.S.C. 154(b) by 0 days.

(21) Appl. No.: 09/332,601

(22) Filed: Jun. 14, 1999

(30) Foreign Application Priority Data

Oct. 15, 1998 (GB) ..... 9822421
Apr. 26, 1999 (GB) ..... 9909382

(51) Int. Cl.[7] ..... H04R 5/00
(52) U.S. Cl. ..... 381/18; 381/17
(58) Field of Search ..... 381/17, 18, 1

(56) References Cited

U.S. PATENT DOCUMENTS 5,438,623 A * 8/1995 Begault ..... 381/17
5,644,640 A * 7/1997 Fosgate ..... 381/18
5,822,438 A * 10/1998 Sekine et al. ..... 381/17
5,917,916 A * 6/1999 Sibbald et al. ..... 381/1
6,243,476 B1 * 6/2001 Gardner ..... 381/1

* cited by examiner

*Primary Examiner*—Ping Lee
(74) *Attorney, Agent, or Firm*—Oliff & Berridge PLC

(57) ABSTRACT

A method of synthesizing a three dimensional sound-field using a pair of front and a pair of rear loudspeakers, including: a) determining the desired position of a sound source; b) providing a binaural pair of signals corresponding to the sound source using an HRTF filter; c) providing the left signal of said binaural pair of signals to both the left front and left rear loudspeakers through a front and a rear gain control means respectively; d) providing the right signal of said binaural pair of signals to both the right front and right rear loudspeakers through a front and a rear gain control means respectively; e) controlling the ratio of the front signal gains to the rear signal gains as a function of the azimuth angle of the sound source; and f) performing transaural crosstalk cancellation on the front and rear signal pairs through respective transaural crosstalk cancellation means.

10 Claims, 12 Drawing Sheets

Figure 12:
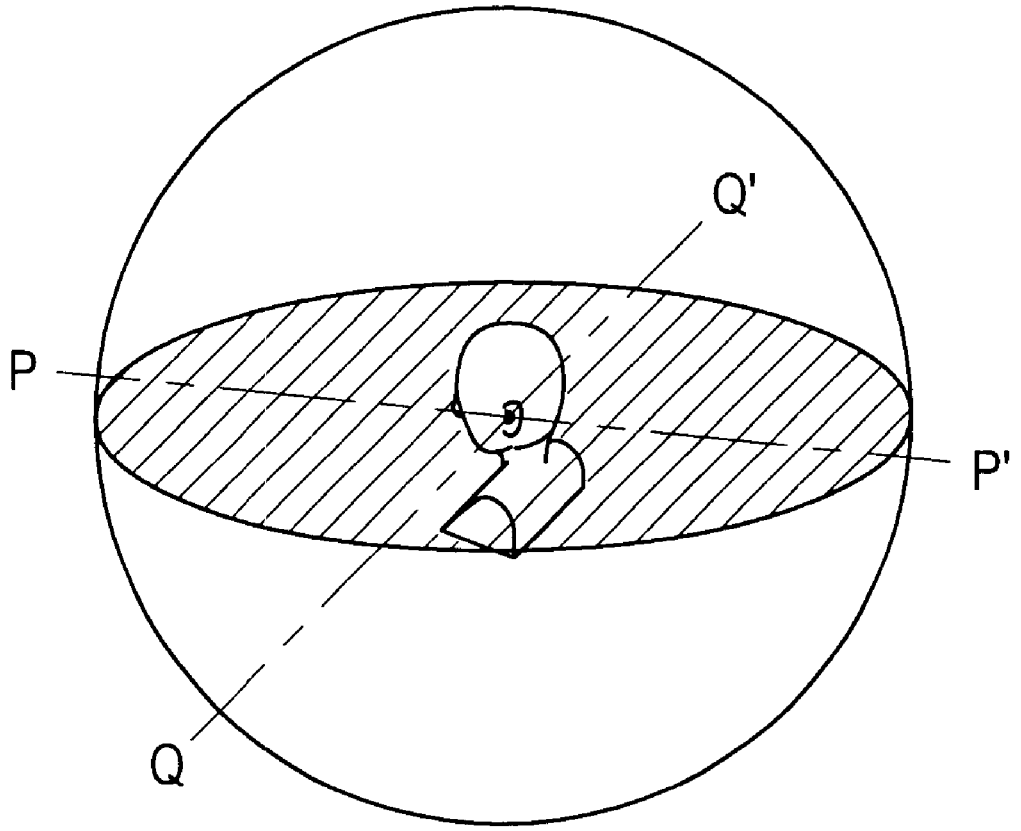

Four loudspeaker system with spatially dependent crossfading.

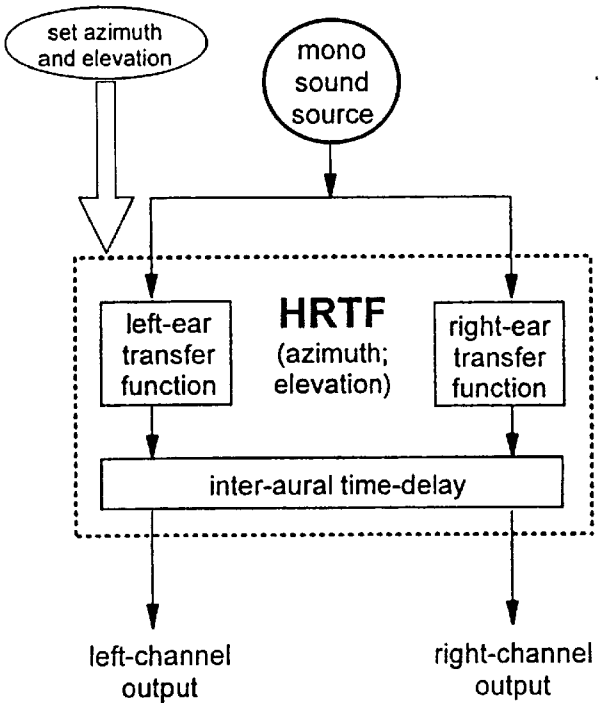
Figure 1: Schematic representation of the conventional method for positioning a virtual sound source using HRTF-based signal-processing: "binaural placement".

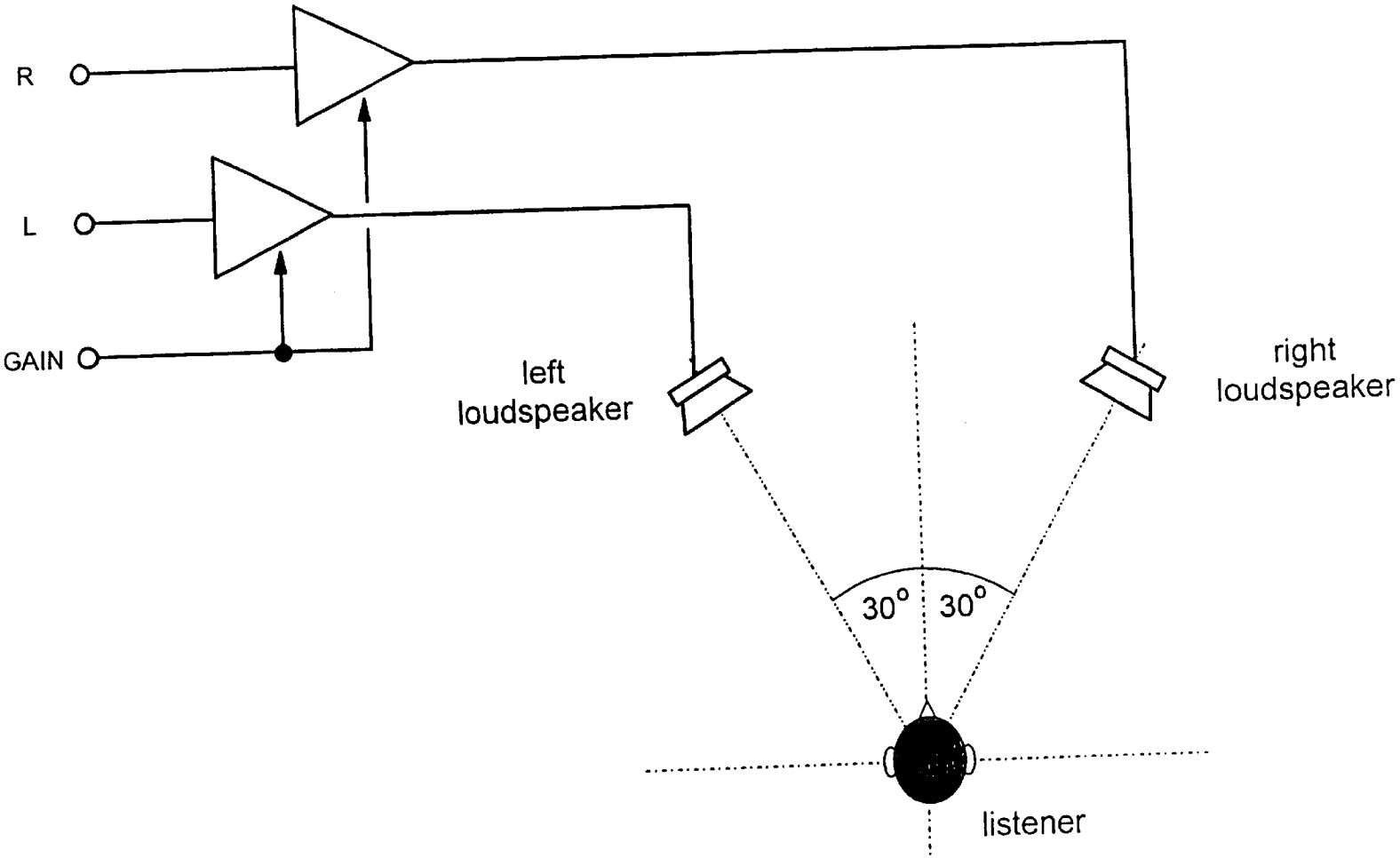
Figure 2: Conventional, two loudspeaker listening arrangement.

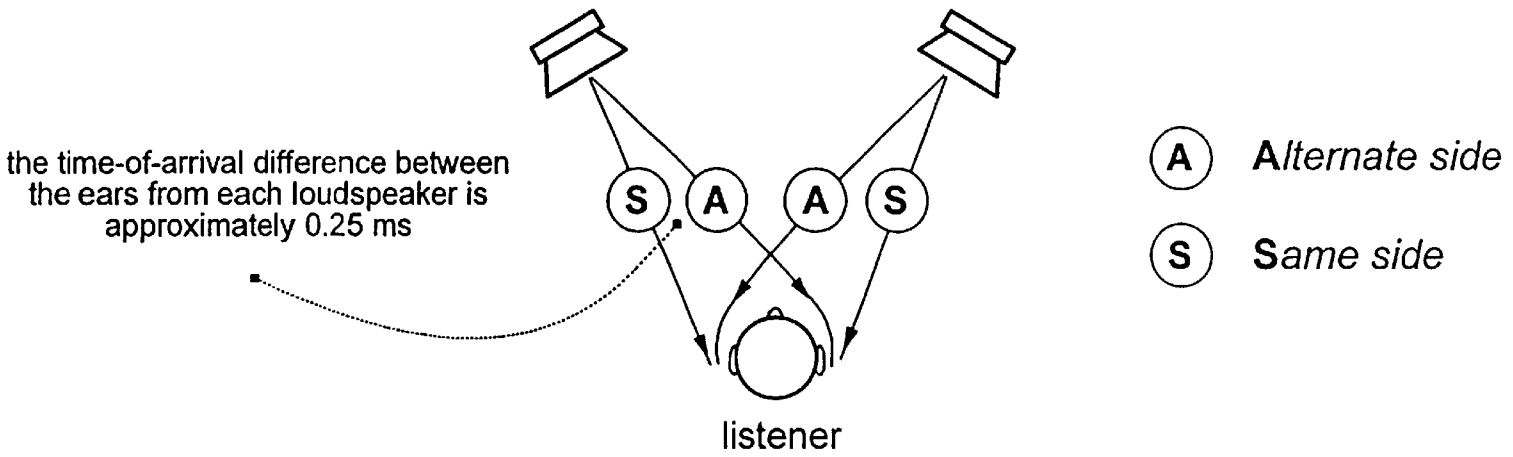
Figure 3: Transfer functions associated with two-speaker configuration, showing the direct sound paths (S) and the transaural crosstalk paths (A).

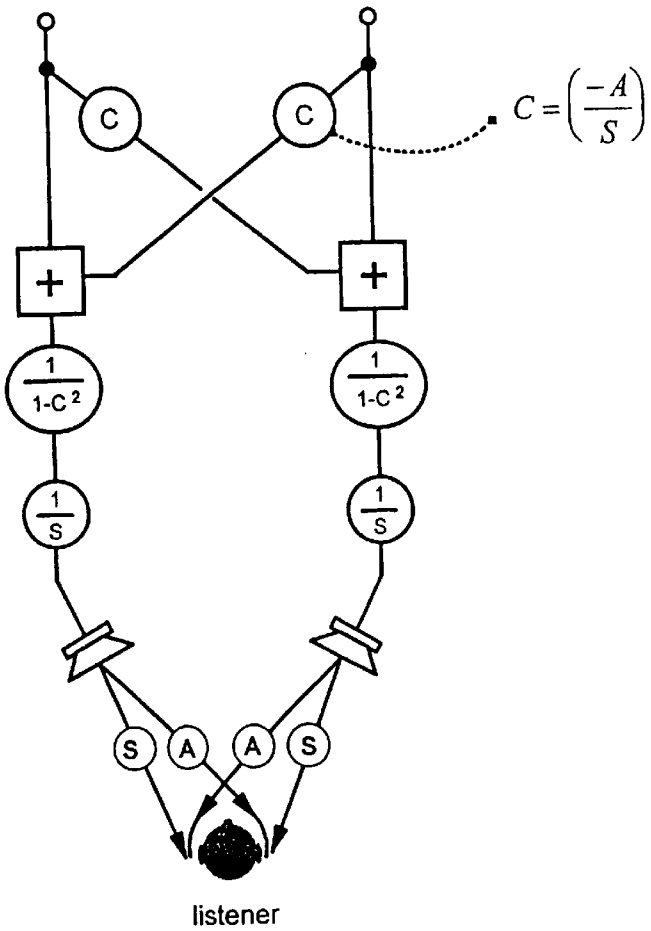
Figure 4: Typical transaural crosstalk cancellation scheme.

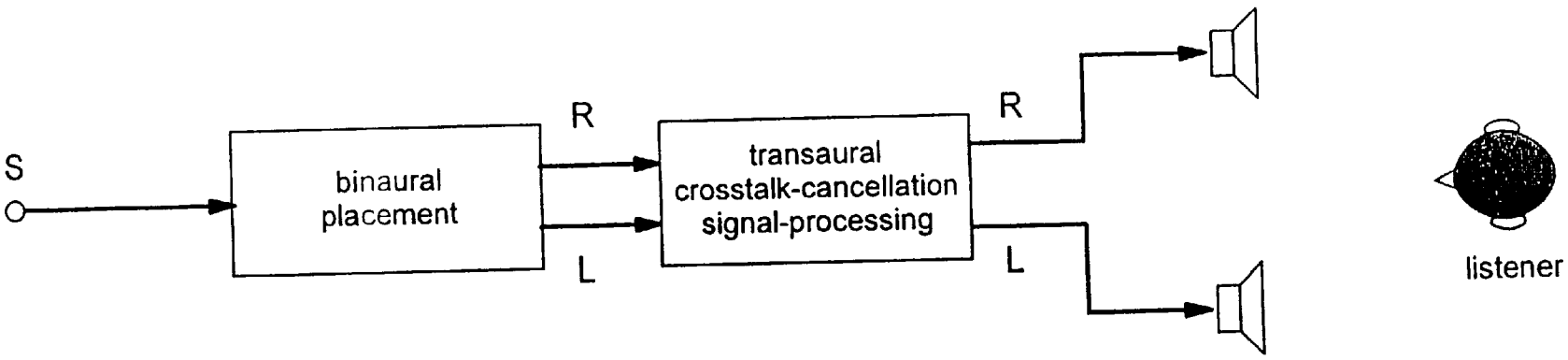
Fig 5: Use of transaural crosstalk cancellation processing for reproducing a virtual sound source via loudspeakers.

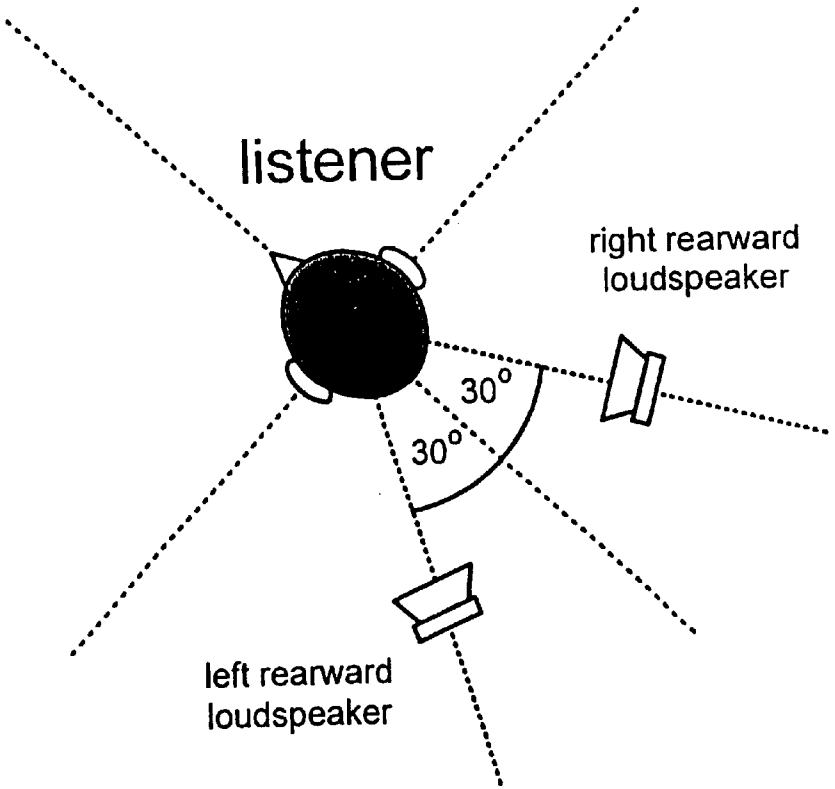
Figure 6: Rearward, two-loudspeaker listening arrangement.

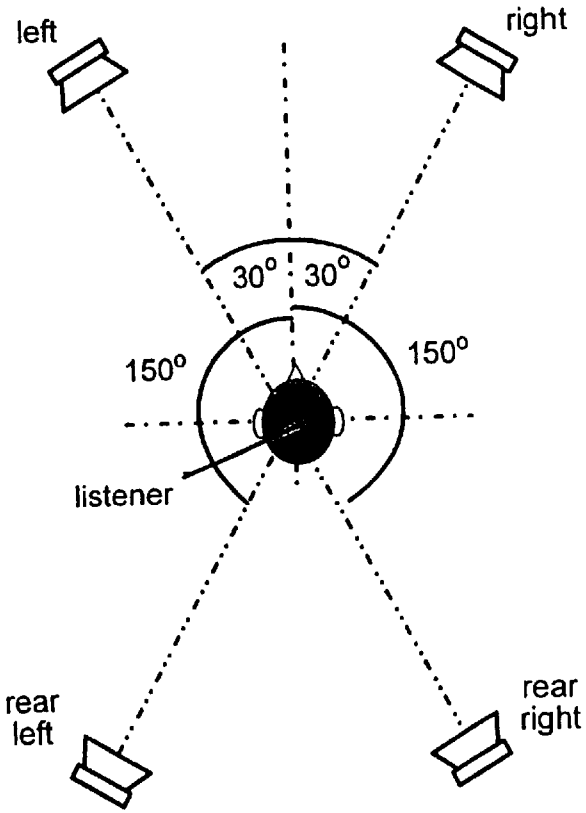
Figure 7: Four loudspeaker listening arrangement.

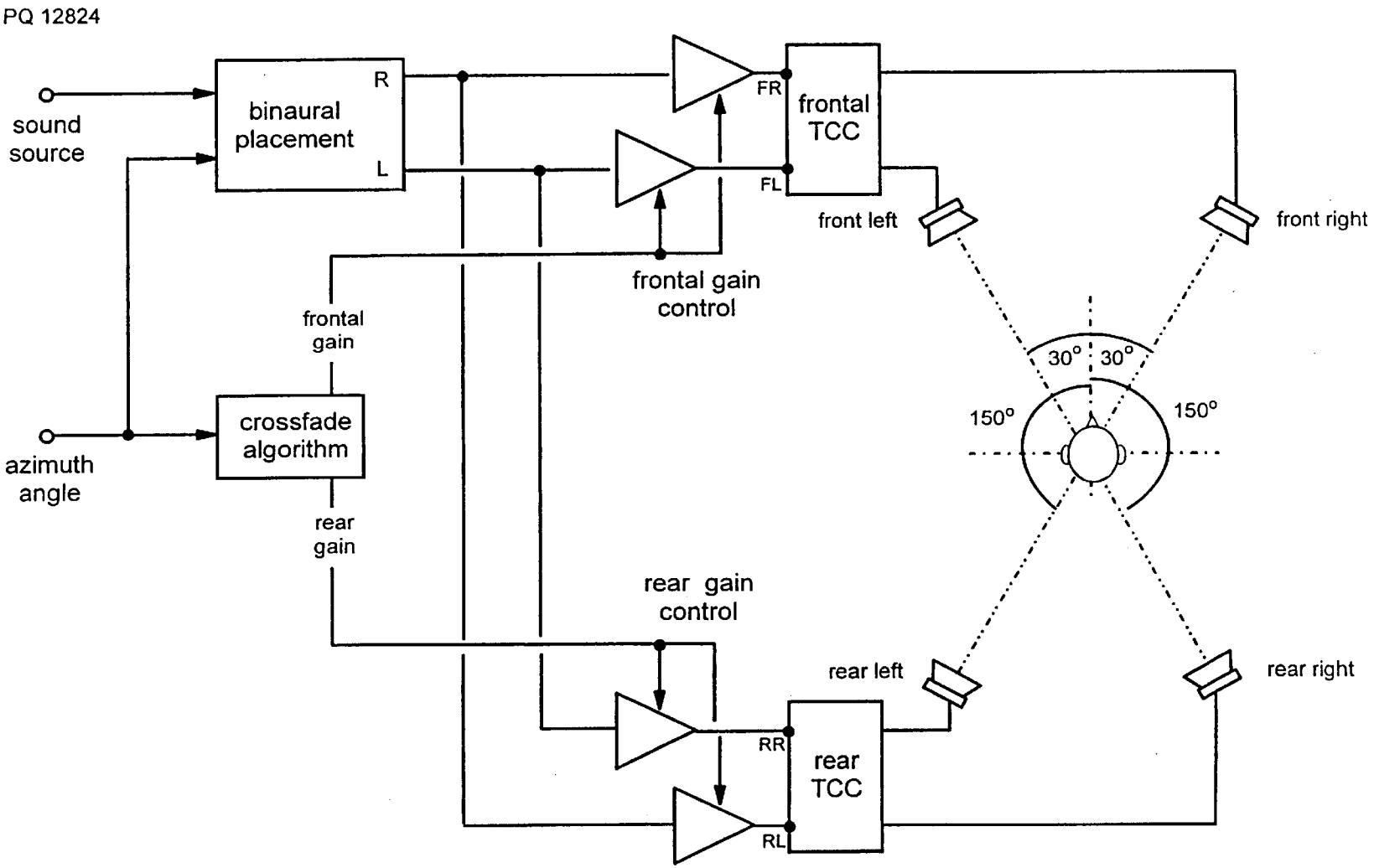
Figure 8: Four loudspeaker system with spatially dependent crossfading.

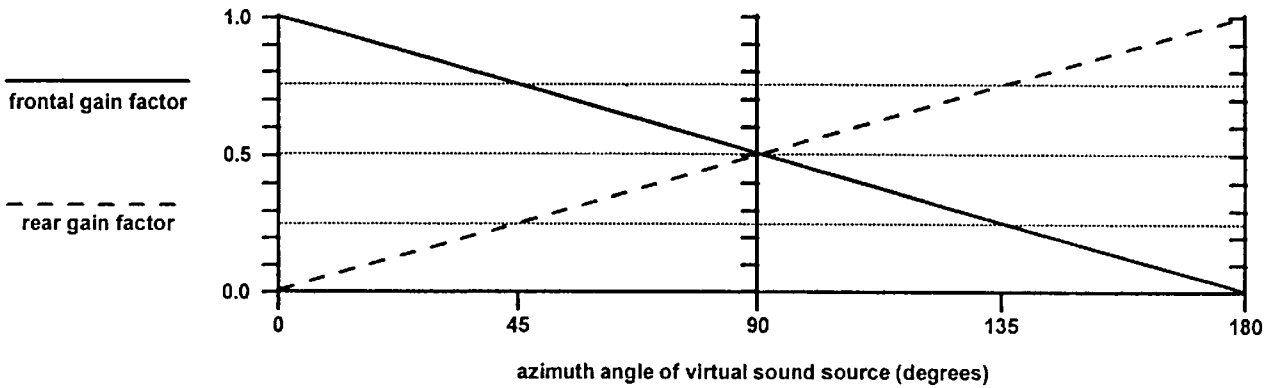
Figure 9(a) : Spatially dependent crossfading relationship: linear, 100% crossfade between 0 and 180 degrees
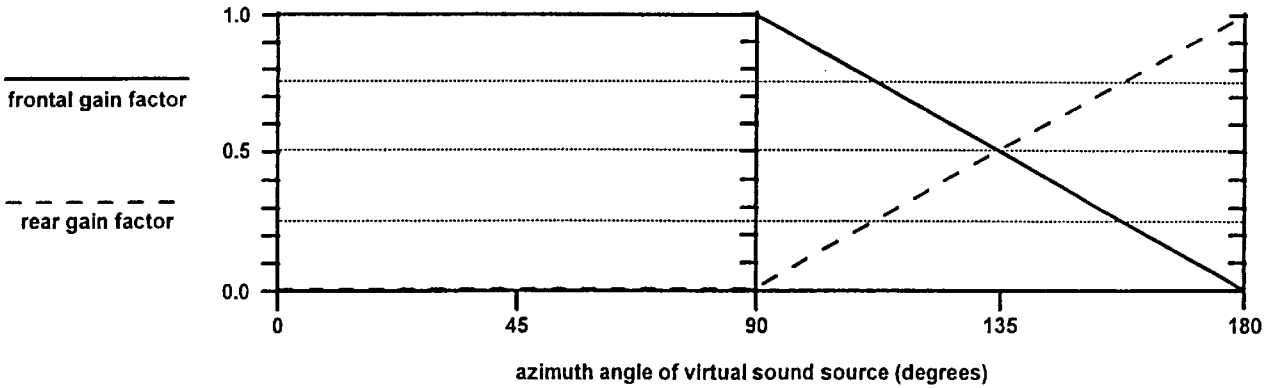
Figure 9(b) : Spatially dependent crossfading relationship: linear, 100% crossfade between 90 and 180 degrees

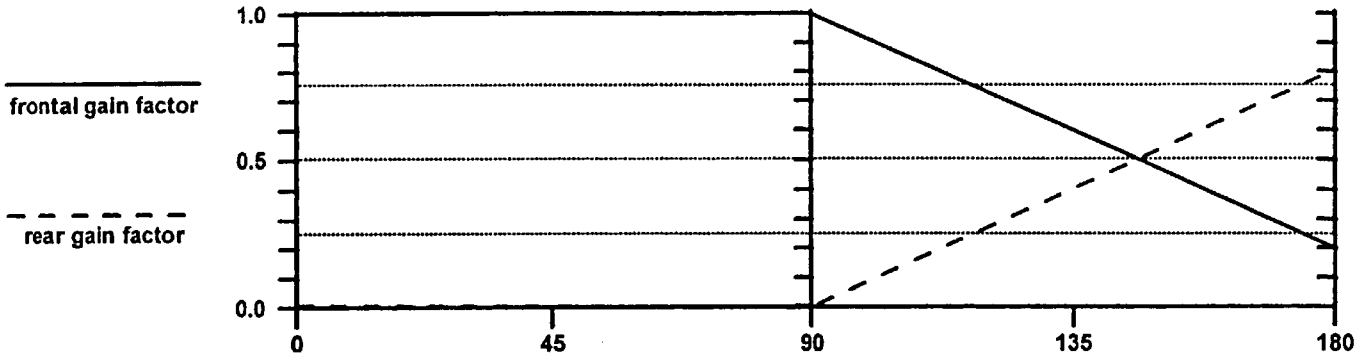
Figure 10(a): Spatially dependent crossfading relationship: linear, 80% crossfade between 90 and 180 degrees;
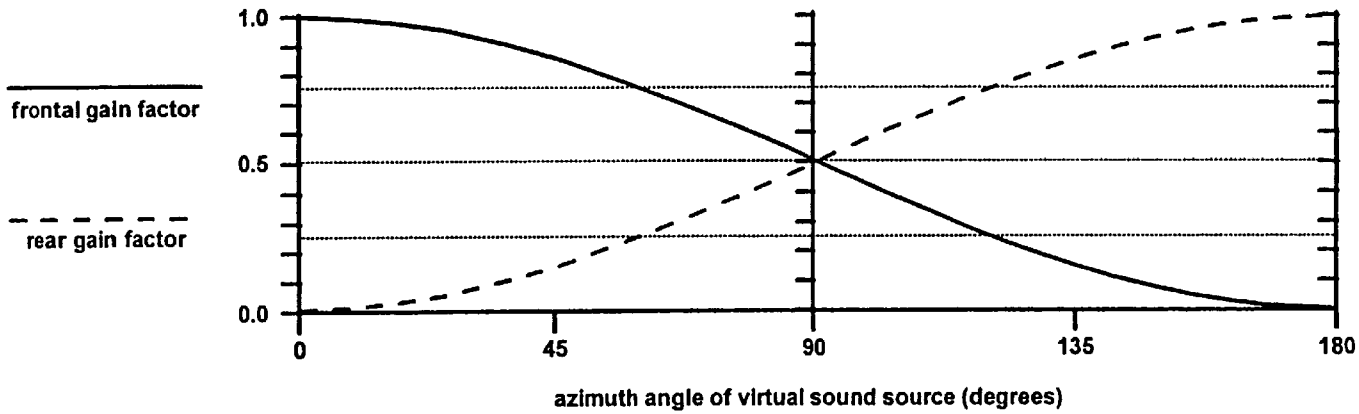
Figure 10(b): Spatially dependent crossfading relationship: non-linear, 100% crossfade between 0 and 180 degrees.

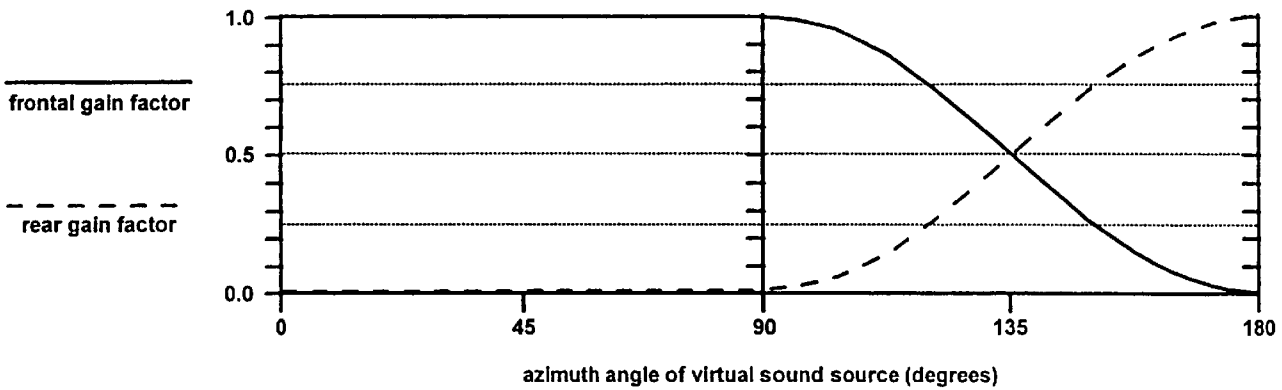
Figure 11(a): Spatially dependent crossfading relationship: non-linear, 100% crossfade between 90 and 180 degrees;
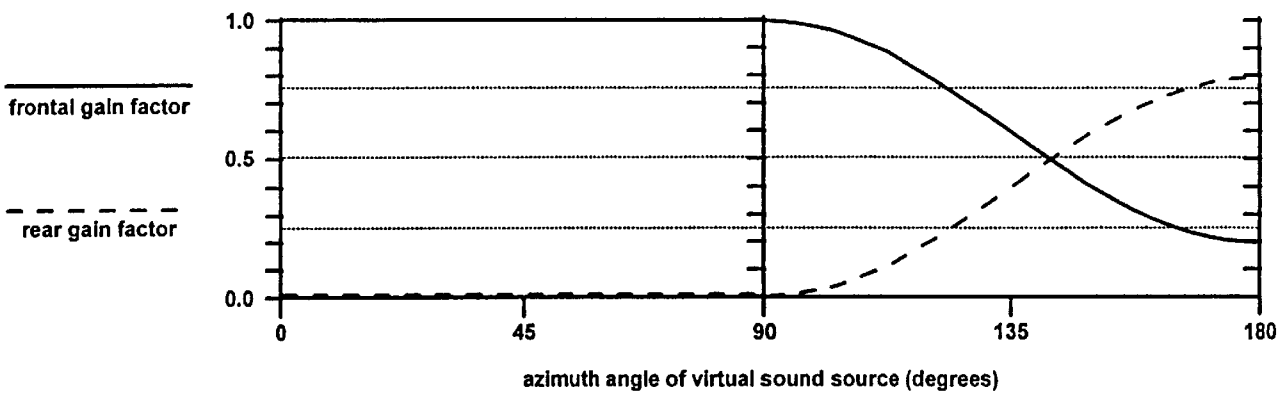
Figure 11(b): Spatially dependent crossfading relationship: non-linear, 80% crossfade between 90 and 180 degrees.

METHOD OF SYNTHESIZING A THREE DIMENSIONAL SOUND-FIELD

This invention relates to a method of synthesising a three dimensional sound field.

The processing of audio signals to reproduce a three dimensional sound-field on replay to a listener having two ears has been a goal for inventors for many years. One approach has been to use many sound reproduction channels to surround the listener with a multiplicity of sound sources such as loudspeakers. Another approach has been to use a dummy head having microphones positioned in the auditory canals of artificial ears to make sound recordings for headphone listening. An especially promising approach to the binaural synthesis of such a sound-field has been described in EP-B-0689756, which describes the synthesis of a sound-field using a pair of loudspeakers and only two signal channels, the sound-field nevertheless having directional information allowing a listener to perceive sound sources appearing to lie anywhere on a sphere surrounding the head of a listener placed at the centre of the sphere.

A monophonic sound source can be digitally processed via a "Head-Response Transfer Function" (HRTF), such that the resultant stereo-pair signal contains natural 3D-sound cues as shown in FIG. 1. The HRTF can be implemented using a pair of filters, one associated with a left ear response and the other with a right ear response, sometimes called a binaural placement filter. These sound cues are introduced naturally by the acoustic properties of the head and ears when we listen to sounds in real life, and they include the inter-aural amplitude difference (IAD), inter-aural time difference (ITD) and spectral shaping by the outer ear. When this stereo signal pair is introduced efficiently into the appropriate ears of the listener, by headphones say, then he or she perceives the original sound to be at a position in space in accordance with the spatial location associated with the particular HRTF which was used for the signal-processing.

When one listens through loudspeakers instead of headphones, as is shown in FIG. 2, then the signals are not conveyed efficiently into the ears, for there is "transaural acoustic crosstalk" present which inhibits the 3D-sound cues. This means that the left ear hears a little of what the right ear is hearing (after a small, additional time-delay of around 0.25 ms), and vice versa as shown in FIG. 3. In order to prevent this happening, it is known to create appropriate "crosstalk cancellation" or "crosstalk compensations" signals from the opposite loudspeaker. These signals are equal in magnitude and inverted (opposite in phase) with respect to the crosstalk signals, and designed to cancel them out. There are more advanced schemes which anticipate the secondary (and higher order) effects of the cancellation signals themselves contributing to secondary crosstalk, and the correction thereof, and these methods are known in the prior art. A typical prior-art scheme (after M R Schroeder "Models of hearing", Proc. IEEE, vol. 63 issue 9, [1975] pp. 1332–1350) is shown in FIG. 4.

When the HRTF processing and crosstalk cancellation are carried out sequentially (FIG. 5) and correctly, and using high quality HRTF source data, then the effects can be quite remarkable. For example, it is possible to move the image of a sound-source around the listener in a complete horizontal circle, beginning in front, moving around the right-hand side of the listener, behind the listener, and back around the left-hand side to the front again. It is also possible to make the sound source move in a vertical circle around the listener, and indeed make the sound appear to come from any selected position in space. However, some particular positions are more difficult to synthesise than others, some it is believed for psychoacoustic reasons, and some for practical reasons.

For example, the effectiveness of sound sources moving directly upwards and downwards is greater at the sides of the listener (azimuth=90°) than directly in front (azimuth=0°). This is probably because there is more left-right difference information for the brain to work with. Similarly, it is difficult to differentiate between a sound source directly in front of the listener (azimuth=0°) from a source directly behind the listener (azimuth=180°). This is because there is no time-domain information present for the brain to operate with (ITD=0), and the only other information available to the brain, spectral data, is somewhat similar in both of these positions. In practise, there is more high frequency (HF) energy perceived when the source is in front of the listener, because the high frequencies from frontal sources are reflected into the auditory canal from the rear wall of the concha, whereas from a rearward source, they cannot diffract around the pinna sufficiently.

In practical terms, a limiting feature in the reproduction of 3D-sound from two loudspeakers is the adequacy of the transaural crosstalk cancellation, and there are three significant factors here, as follows.

1. HRTF quality. The quality of the 30° HRTF (FIG. 3) used to derive the cancellation algorithms (FIG. 4) is important. Both the artificial head from which they derive and the measurement methodology must be adequate.
2. Signal-processing algorithms. The algorithms must be executed effectively.
3. HF effects. In theory, it is possible to carry out "perfect" crosstalk cancellation, but not in practise. Setting aside the differences between individual listeners and the artificial head from which the algorithm HRTFs derive, the difficulties relate to the high frequency components, above several kHz. When optimal cancellation is arranged to occur at each ear of the listener, the crosstalk wave and the cancellation wave combine to form a node. However, the node exists only at a single point in space, and as one moves further away from the node, then the two signals are no longer mutually time-aligned, and so the cancellation is imperfect. For gross misalignment, then the signals can actually combine to create a resultant signal which is greater at certain frequencies than the original, unwanted crosstalk itself. However, in practise, the head acts as an effective barrier to the higher frequencies because of its relative size with respect to the wavelengths in question, and so the transaural crosstalk is limited naturally, and the problem is not as bad as might be expected.

There have been several attempts to limit the spatial dependency of crosstalk cancellation systems at these higher frequencies. Cooper and Bauck (U.S. Pat. No. 4,893,342) introduced a high-cut filter into their crosstalk cancellation scheme, so that the HF components (>8 kHz or so) were not actually cancelled at all, but were simply fed directly to the loudspeakers, just as they are in ordinary stereo. The problem with this is that the brain interprets the position of the HF sounds (i.e. "localises" the sounds) to be where the loudspeakers themselves are, because both ears hear correlating signals from each individual speaker. It is true that these frequencies are difficult to localise accurately, but the overall effect is nevertheless to create HF sounds of frontal origin for all required spatial positions, and this inhibits the illusion when trying to synthesise rearward-positioned sounds.

Even when the crosstalk is optimally cancelled at high frequencies, the listener's head is never guaranteed to be exactly correctly positioned, and so again, the non-cancelled HF components are "localised" by the brain at the speakers themselves, and therefore can appear to originate in front of the listener, making rearward synthesis difficult to achieve.

The following additional practical aspects also hinder optimal transaural crosstalk cancellation:

1. The loudspeakers often do not have well-matched frequency responses.
2. The audio system may not have well-matched L-R gain.
3. The computer configuration (software presets) may be set so as to have inaccurate L-R balance.

Many sound sources which are used in computer games contain predominantly low-frequency energy (explosion sounds, for example, and "crash" effects), and so the above limitations are not necessarily serious because the transaural crosstalk cancellation is adequate for these long wavelength sources. However, if the sound sources were to contain predominantly higher-frequency components, such as bird-song, and especially if they comprise relatively pure sine-wave type sounds, then it would be very difficult to provide effective crosstalk cancellation. Bird-song, insect calls and the like, can be used to great effect in a game to create ambience, and it is often required to position such effects in the rearward hemisphere. This is particularly difficult to do using presently known methods.

According to the present invention there is provided a method of synthesising a three dimensional sound-field using a system including a pair of front loudspeakers arranged in front of a preferred position of a listener and a pair of rear loudspeakers arranged behind said preferred position, including:

a) determining the desired position of a sound source in said three dimensional sound-field relative to said preferred position;
b) providing a binaural pair of signals comprising a left channel and a right channel corresponding to said sound source in said three dimensional sound field;
c) controlling the gain of the left channel signal of said binaural pair of signals using a front signal gain control means and a rear signal gain control means to provide respective gain controlled front left and rear left signals respectively;
d) controlling the gain of the right channel signal of said binaural pair of signals using a front signal gain control means and a rear signal gain control means to provide respective gain controlled front right and rear right signals respectively;
e) controlling the ratio of the front signal pair gain to the rear signal pair gain as a function of the desired position of said localised sound source relative to said preferred position; and
f) performing transaural crosstalk compensation on the gain controlled front signal pair and rear signal pair using respective transaural crosstalk compensation means, and using these two compensated signal pairs to drive the corresponding loudspeakers in use.

The present invention relates to the reproduction of 3D-sound from multiple-speaker stereo systems, and especially four-speaker systems, for providing improved effectiveness of rearward placement of virtual sound sources. Whereas present two-loudspeaker 3D-sound systems are advantageous over multi-speaker systems for the obvious reasons of cost, wiring difficulties and the need for extra audio drivers, the present invention takes advantage of the fact that a proportion of multi-media users will already possess, or will buy, a 4 (or more) speaker configuration to cater for alternative formats, such as Dolby Digital™. (Note, however, that such formats are only 2D "surround" systems, incapable of true 3D source placement, unlike the present invention.) The present invention enables conventional, two-speaker, 3D-sound material to be replayed over such four (or more) speaker systems, to provide true, 3D virtual source placement. The invention is especially valuable in rendering effective rearward placement of virtual sound sources which are rich in HF (high frequencies), thus providing enhanced 3D-sound for the listener. This is achieved in a very simple, but effective, way.

First, for descriptive reasons, it is useful to establish a spatial reference system with respect to the listener, as is shown in FIG. 12, which depicts the head and shoulders of a listener surrounded by a unit-dimension reference sphere.

The horizontal plane cutting the sphere is shown in FIG. 12, together with the horizontal axes. The front-rear axis is P–P', and the lateral axis is Q–Q', both passing through the centre of the listener's head. The convention chosen here for referring to azimuth angles is that they are measured from the frontal pole (P) towards the rear pole (P'), with positive values on the right-hand side of the listener and negative ones on the left-hand side. For example, the right-hand side pole, Q', is at an azimuth angle of +90°, and the left-hand pole (Q) is at −90°. Rear pole P' is at 30 180° (and −180°). The median plane is that which bisects the head of the listener vertically in a front-back direction (running along axis P–P'). Angles of elevation are measured directly upwards (or downwards, as appropriate) from the horizontal plane.

In principle, a two-channel 3D-sound signal can be replayed effectively through either (a) a frontal pair of speakers (±30°); (b) a rearward pair of speakers (±150°), as described in GB 2311706 B; or (c) both of these simultaneously. However, when the crosstalk cancellation is caused to be less than fully effective, for reasons described previously, such as poor L-R balance, then the virtual sound images are either moved towards the loudspeaker positions, or "smeared out" between their location and the speakers. In extreme conditions, the image can break down and be unclear. The following two examples illustrate the point.

EXAMPLE 1

If a frontal virtual source, at ±45° azimuth, say, is being reproduced by a conventional (front) pair of loudspeakers at ±30°, and if there is less than optimal transaural crosstalk cancellation for any of the aforementioned reasons, then the sound image will be drawn to the loudspeaker positions, and especially to the near-ear loudspeaker (i.e. the right-hand speaker position: +30°). This is not desirable, clearly, but the positional "error" from +45° to +30° is relatively small. However, if the virtual source were rearward, at +150°, say, then the same effect would occur, but the "error" would be very great (+150° to +30°), causing the image to break down, and pulling the rearward image to the front of the listener.

EXAMPLE 2

If a rearward virtual source, at +135° azimuth, say, is being reproduced by a rearward pair of loudspeakers at ±150° (FIG. 6), and, once again, there is less than optimal transaural crosstalk cancellation, then the sound image again will be drawn to the loudspeaker positions, and especially to the near-ear loudspeaker (i.e. the right-hand speaker position: +150°). In this case the positional "error" from +135° to +150° would be relatively small. However, if the virtual sound source were frontally positioned, however, at +30° say, then the same effect would occur, but the "error" would be very great (+30° to +150°), causing the image to break down, and pulling the frontal image to the rear of the listener.

From the above two examples, it can be inferred that a rearward loudspeaker pair is better for reproducing rearward virtual images than frontal ones, and a frontal loudspeaker pair is better for reproducing frontal images than rearward ones.

But now consider a third option, where a frontal and rearward pair are used together, equally loud, and equally spaced from the listener. In these circumstances, when there is less than optimal transaural crosstalk cancellation, the sound image is drawn to the loudspeaker positions, both frontal and rearward, with resultant breakdown of the sound image which becomes confusing and vague.

In contrast to these unsatisfactory options, the present invention takes advantage of this "image-pulling" effect, by preferentially steering the frontal virtual sound sources to a frontal pair of loudspeakers, and steering rearward virtual sound sources to a rearward pair of loudspeakers. Consequently, if the crosstalk cancellation is less than adequate, the virtual sound sources are "pulled" into the correct hemispheres, rather than being disrupted. The steering can, for example, be accomplished by means of an algorithm which uses the azimuth angle of each virtual sound source to determine what proportion of the L-R signal pair to transmit to the frontal and rearward speakers respectively. A description is as follows.

a) A four-speaker configuration is arranged, as shown in FIG. 7, in the horizontal plane, with the speakers located symmetrically about the median plane, with speakers at ±30° and ±150°. (These parameters can be chosen, of course, to suit a variety of differing listening arrangements.)

b) The left channel signal source is fed to both left-side speakers, first via frontal and rearward gain control means respectively, followed by frontal and rearward transaural crosstalk cancellation means.

c) The right channel signal source is fed to both right-side speakers, first via frontal and rearward gain control means respectively, followed by frontal and rearward transaural crosstalk cancellation means.

d) The frontal and rearward gain control means are controlled simultaneously and in a complementary manner, so as preferably to provide overall unity gain (or thereabouts) for the sum of both front and rear elements, such that there is little or no perceived change in sound intensity if the position of the sound image is moved around the listener.

A schematic diagram of the invention is shown in FIG. 8. (For the purpose of clarity, only a single sound source is depicted and described below, but multiple sound sources are used in practise, of course, as will be described later.) Referring to FIG. 8, the signal processing occurs as follows.

1. A sound source is fed into an HRTF "binaural placement" filter, according to the detail of FIG. 1, thus creating both a L and R channel for subsequent processing.
2. The L and R channel pair is fed (a) into frontal gain control means, and (b) into rearward gain control means.
3. The frontal and rearward gain control means control the gains of the frontal and rearward channel pairs respectively, such that a particular gain factor is applied equally to the frontal L and R channel pair, and another particular gain factor is applied equally to the rearward L and R channel pair.
4. The L and R outputs of the frontal gain control means are fed into a frontal crosstalk cancellation means, from which the respective frontal speakers are driven.
5. The L and R outputs of the rearward gain control means are fed into a rearward crosstalk cancellation means, from which the respective rearward speakers are driven.
6. The respective gains of the frontal and rearward gain control means are controlled so as to be determined by the azimuth angle of the virtual sound source, according to a simple, pre-determined algorithm.
7. The sum of the respective gains of the frontal and rearward gain control means, typically, is unity (although this does not have to be so, if personal preferences require a front or rear-biased effect).

If a multiplicity of sound sources is to be created according to the invention, then each source must be treated on an individual basis according to the signal paths shown in FIG. 8 up to the TCC stage, and then the respective front-right, front-left, rear-right and rear-left signals from all the sources must be summed and fed into the respective frontal and rearward TCC stages at nodes FR, FL, RR and RL (FIG. 8).

There is a great variety of options which can be used for the algorithm which controls the azimuth angle dependency of the front and rear gain control means. Because the overall effect is to fade progressively between frontal and rearward loudspeakers, in an azimuth-angle-dependent manner, the descriptive term "crossfade" has been used in the following examples. These examples have been chosen to indicate the most useful algorithm variants, illustrating the three main factors of (a) linearity, (b) crossfade region, and (c) crossfade modulus, and are depicted in FIGS. 9, 10 and 11.

FIG. 9*a* shows the simplest crossfading algorithm, in which the frontal gain factor is unity at 0°, and reduces linearly with azimuth angle to be zero at 180°. The rearward gain factor is the inverse function of this. At azimuth 90°, both front and rear gain factors are equal (0.5).

FIG. 9*b* shows a linear crossfading algorithm, similar to 9*a*, but the initial crossfade point has been chosen to be 90° rather than 0°. Hence, the frontal gain factor is unity between 0° and 90°, and then it reduces linearly with azimuth angle to zero at 180°. The rearward gain factor is the inverse function of this.

FIG. 10*a* shows a similar algorithm to 9*b*, but with the crossfade to the rearward channel limited to 80%. Hence the frontal gain factor is unity between 0° and 90°, and then it reduces linearly with azimuth angle to be 0.2 at 180°. Again, the rearward gain factor is the inverse function of this.

FIG. 10*b* shows a somewhat similar format to that of FIG. 9*a*, except that the crossfade function is now non-linear. A raised cosine function has been used for the crossfade, which has the advantage that there are no sudden transition points where the rate of change of crossfade suddenly reverses (e.g. when moving through the 0° and 180° positions in the previous examples).

FIG. 11*a* shows a non-linear crossfade with a 90° crossfade initiation point (analogous to the linear method of FIG. 9*b*), and FIG. 11*b* shows a similar, non-linear crossfade, limited to 80% (analogous to FIG. 10*a*).

In the above examples, the algorithm which controls the azimuth angle dependency of the front and rear gain control means is a function of the azimuth angle and is independent of the angle of elevation. However, such algorithms have a disadvantage when angles of elevation are high, as small changes in the position of the virtual sound source can result in large changes in the gain fed to front and rear speakers. For this reason it is preferable to use an algorithm which changes the gains smoothly (i.e. continuously) as a function of both angles. As an example one can use the function $f(\Phi,\theta)=(1-\cos(\theta)\cos(\Phi))/2$, where $\Phi$ is the angle of elevation, and $\theta$ is the angle of azimuth.

The front and right transaural crosstalk cancellation parameters can be configured separately, if so desired, so as to suit non-complementary subtended angles. For example, frontal at ±30° and rearward at ±120°, rather than 150°.

The front and right transaural crosstalk cancellation parameters can be configured separately, if so desired, so as to suit differing distances between the listener and the rear speakers, and the listener and the front speakers, as described in our co-pending applications GB 9816059.1 and U.S. Ser. No. 09/185,711, which are incorporated herein by reference.

Although a set of head response transfer functions covering the full 360 degrees can be used, it can be advantageous just to use the front hemisphere HRTFs for both the front and rear hemisphere, thus saving storage space or processing power. This is because if you use the rear hemisphere HRTFs, twice the spectral modification required is produced, because the listener's head provides its own spectral modification in addition to that introduced by the HRTF. Thus the head response transfer function provided for a localised sound source having a desired position located in front of the preferred position of the listener at a given angle of azimuth of $\theta$ degrees is preferably substantially the same as the head response transfer function provided for a localised sound source having a desired position located behind the preferred position of the listener at an angle of azimuth of $(180-\theta)$ degrees.

The invention can be configured to work with additional pairs of speakers, simply by adding appropriate gain and TCC stages, building on the architecture shown in FIG. 8. This would still require only a single binaural placement stage for each sound source, as at present, and the respective TCC stages would sum the contributions from the respective gain stages. For example, a third speaker pair (i.e. making 6 in all), positioned laterally, say, at ±90°, would require no additional binaural placement stages, one extra pair of gain stages for each source, and a single extra TCC stage for the additional speaker pair, configured for the appropriate angle (90° in this example) and distance.

It is sometimes desired to combine a normal stereo feed, or a multi-channel surround sound feed together with the localised sound sources provided by the present invention. In order to accomplish this, the signals for each loudspeaker provided by the present invention can be simply added to the signals from the other source prior to transmission to the loudspeakers to create the desired combination.

What is claimed is:

1. A method of synthesizing a three dimensional sound-field using a system including a pair of front loudspeakers arranged in front of a preferred position for a listener and a pair of rear loudspeakers arranged behind said preferred position, the method including:

a) determining a desired position of a localized sound source in said three dimensional sound-field relative to said preferred position;

b) providing a binaural pair of signals comprising a left channel and a right channel corresponding to said localized source in said three dimensional sound field;

c) controlling the gain of the left channel signal of said binaural pair of signals using a front signal gain control means and a rear signal gain control means to provide respective gain controlled front left and rear left signals respectively;

d) controlling the gain of the right channel signal of said binaural pair of signals using a front signal gain control means and a rear signal gain control means to provide respective gain controlled front right and rear right signals respectively;

e) controlling the ratio of the front signal gains to the rear signal gains as a function of the desired position of said localized sound source relative to said preferred position; and f) performing transaural crosstalk compensation on the gain controlled front signal pair and rear signal pair using respective transaural crosstalk compensation means, and using these two compensated signal pairs to drive the corresponding loudspeakers in use.

2. A method as claimed in claim 1, in which step e) is performed such that the ratio of the front signal gains to that of the rear signal gains is determined from the azimuth angle of the said localised sound source relative to said preferred position.

3. A method as claimed in claim 1 in which step e) is performed such that the ratio of the front signal gains to that of the rear signal gains is a continuous function of the azimuth angle of the said localised sound source relative to said preferred position.

4. A method as claimed in claim 1 in which step e) is performed such that the ratio of the front signal gains to that of the rear signal gains is a continuous function of both the azimuth angle and angle of elevation of the said localised sound source relative to said preferred position.

5. A method as claimed in claim 1 in which the binaural pair of signals is provided by passing a monophonic signal through filter means which implements a head response transfer function.

6. A method as claimed in claim 5, in which the head response transfer function provided for a localised sound source having a desired position located in front of the preferred position of the listener at a given angle of azimuth of $\theta$ degrees is substantially the same as the head response transfer function provided for a localised sound source having a desired position located behind the preferred position of the listener at an angle of azimuth of $(180-\theta)$ degrees.

7. A method in which a plurality of signals each corresponding to a sound source are synthesised as claimed in claim 1, respective channels of each signal being summed together to give a combined pair of front signals and a combined pair of rear signals which are subsequently transaural crosstalk compensated.

8. A method as claimed in claim 1 in which the loudspeakers are used simultaneously to provide an additional plural channel audio signal, this additional signal being added to the transaural crosstalk compensated signals and fed to respective loudspeakers.

9. Apparatus including a computer system which is programmed to perform a method as claimed in claim 1.

10. A method of synthesizing a three dimensional sound-field using a system including a pair of front loudspeakers arranged in front of a preferred position for a listener and a pair of rear loudspeakers arranged behind said preferred position, the method comprising:

a) determining a desired position of a localized sound source in said three dimensional sound-field relative to said preferred position;

b) providing a binaural pair of signals comprising a left channel and a right channel corresponding to said localized source in said three dimensional sound field;

c) controlling the gain of the left channel signal of said binaural pair of signals using a front signal gain control means and a rear signal gain control means to provide respective gain controlled front left and rear left signals respectively;

d) controlling the gain of the right channel signal of said binaural pair of signals using a front signal gain control means and a rear signal gain control means to provide respective gain controlled front right and rear right signals respectively;

e) controlling the ratio of the front signal gains to the rear signal gains as a function of the desired position of said localized sound source relative to said preferred position; and f) performing transaural crosstalk compensation on the gain controlled front signal pair and rear signal pair using respective transaural crosstalk compensation means, and using these two compensated signal pairs to drive the corresponding loudspeakers in use, wherein an image of the localized sound source can be moved in a horizontal circle and a vertical circle around the preferred position for the listener.

* * * * *